US009343798B2

(12) United States Patent
Wong et al.

(10) Patent No.: US 9,343,798 B2
(45) Date of Patent: May 17, 2016

(54) HIGH PERFORMANCE (MINI-CUBE) INDOOR HDTV ANTENNA

(71) Applicants: Gary Gwoon Wong, Torrance, CA (US); Calvin Gwoon Wong, Torrance, CA (US); Kalem Gwoon Wang, Torrance, CA (US)

(72) Inventors: Gary Gwoon Wong, Torrance, CA (US); Calvin Gwoon Wong, Torrance, CA (US); Kalem Gwoon Wang, Torrance, CA (US)

( * ) Notice: Subject to any disclaimer, the term of this patent is extended or adjusted under 35 U.S.C. 154(b) by 611 days.

(21) Appl. No.: 13/573,495

(22) Filed: Sep. 19, 2012

(65) Prior Publication Data

US 2013/0076584 A1 Mar. 28, 2013

Related U.S. Application Data

(60) Provisional application No. 61/626,291, filed on Sep. 26, 2011.

(51) Int. Cl.
*H01Q 13/00* (2006.01)
*H01Q 1/00* (2006.01)
*H01Q 9/40* (2006.01)

(52) U.S. Cl.
CPC ..... *H01Q 1/007* (2013.01); *H01Q 9/40* (2013.01); *Y10T 29/49016* (2015.01)

(58) Field of Classification Search
USPC ..... 343/773, 775, 786, 841
See application file for complete search history.

(56) References Cited

U.S. PATENT DOCUMENTS

| | | | | |
|---|---|---|---|---|
| 4,626,863 | A * | 12/1986 | Knop et al. | 343/781 P |
| 5,907,310 | A * | 5/1999 | Seewig et al. | 343/786 |
| 7,215,294 | B2 * | 5/2007 | Jocher | 343/773 |
| 7,446,725 | B2 * | 11/2008 | Song | H01Q 9/28 343/789 |
| 8,077,113 | B2 * | 12/2011 | Syed et al. | 343/872 |
| 2004/0233118 | A1 * | 11/2004 | Jocher | H01Q 1/36 343/773 |
| 2006/0262020 | A1 * | 11/2006 | Kuroda et al. | 343/773 |

* cited by examiner

*Primary Examiner* — Tan Ho

(57) ABSTRACT

This invention discloses a design and fabrication of a high performance compact antenna to receive public airwaves HDTV signals. The subject antenna consists of a high efficient cone shape broadband element excited over a small metal ground plane. A reflecting surface is implemented to help rejecting any unwanted multiple reflecting signals from the surrounding objects. Outstanding impedance characteristics and broad pattern coverage have been obtained. The pattern coverage is omnidirectional. The polarization is linear along the cone axis. This antenna design operates well in a weak signal environment and as a result the antenna can receive a large number of public channels. Although the antenna measures only 5¾×5¾×3¼ inches in a cubical enclosure or in a 6⅜ inches diameter by 3½ inches depth cylindrical body, the antenna packaged in either enclosure can receive more public channels than a much larger antenna twice of its size. Two invention antennas have been fabricated and tested and the test results confirmed that all antennas of either enclosure were performing well as expected. The invention antennas receive more than 130 public channels.

9 Claims, 2 Drawing Sheets

HIGH PERFORMANCE (MINI-CUBE) INDOOR HDTV ANTENNA

CROSS-REFERENCE TO RELATED APPLICATION

This application claims the benefit of U.S. Provisional Application No. 61/626,291 filled on Sep. 26, 2011.

FIELD

Present disclosure provides new arts in design and fabrication of antennas to receive public air wave signals specifically relating to television antenna.

BACKGROUND

TV transmission in the past for the most part has always been in analog; high gain antennas were required. TV antennas were either Log Periodic or Yagi designs. These antennas are physically large and often require mounting on poles outside the house or building. Today, the HDTV signals are transmitted over UHF and occasionally VHF bands. Also the signals are digitized and spread over a wide band; only very low detectable signals are required for good reception. As a result, only low gain and broad coverage antennas are required for HDTV reception.

The antennas addressed in this disclosure are physically small, requiring no external power. The art of the design is broad band and proving good uniform coverage over the transmission band. These desirable features are evident in the invention antenna. Current antenna art lacks broad band performance and also lack of abilities to reduce inference signals from its surrounding objects.

DRAWINGS

Figure 1:
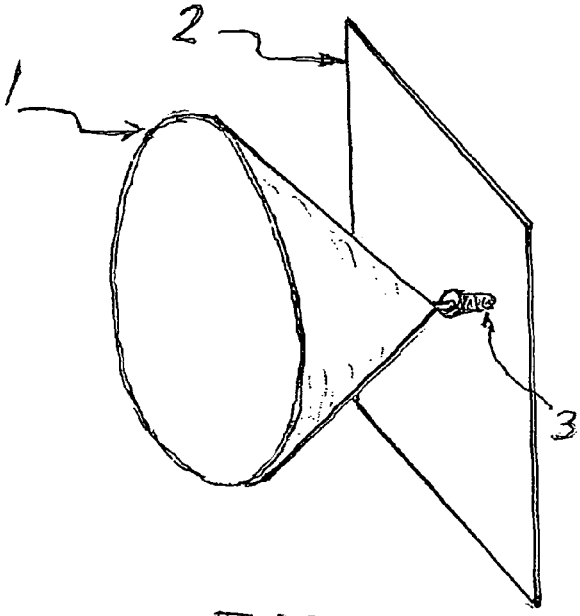

FIG. 1—Cone Element

FIG. 1 is a perspective view of one preferred embodiment of the subject invention containing a cone radiator 1 mounted on a metal ground plane 2 through the F (panel mounted) connector 3. The ground plane 2 is a square shape of 5½ inches which is designed to fit into the FIG. 2 enclosure. The ground plane can be round if the enclosure is designed to be round. The ground plane serves an important purpose; it produces an image effect to the cone element and allows it to radiate as a symmetrical structure. It also helps to reduce the size of the antenna.

Figure 2:
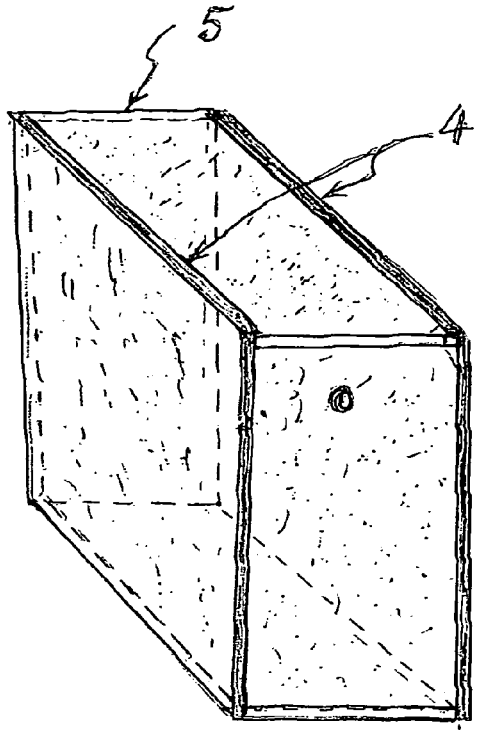

FIG. 2—Cubical Enclosure

FIG. 2 is the perspective view of the antenna enclosure. It is an enclosure of cubical shape. The front and back surfaces of the enclosure are squares and the edge dimension 4 is 5¾ inches and the depth dimension 5 is 3¼ inches. Two of the side walls surfaces are covered by metal surfaces 5*a*.

The materials for forming the enclosure are Abs plastic sheets that are bonded together by a 4SC solvent. Other materials such as wood and numerous plastics may also be used for fabrication of this enclosure. Injection molding processes may also be employed.

Figure 3:
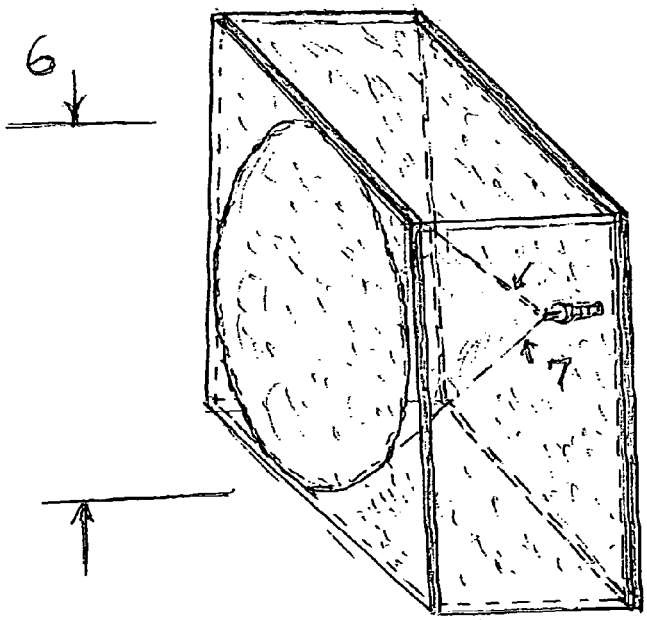

FIG. 3—Cone Element in Cubical Enclosure

FIG. 3 is the prospective view of the cone radiating element packaged into the cubical enclosure. The cone diameter 6 is 5¼ inches and the cone angle 7 is 90 degrees.

Figure 4:
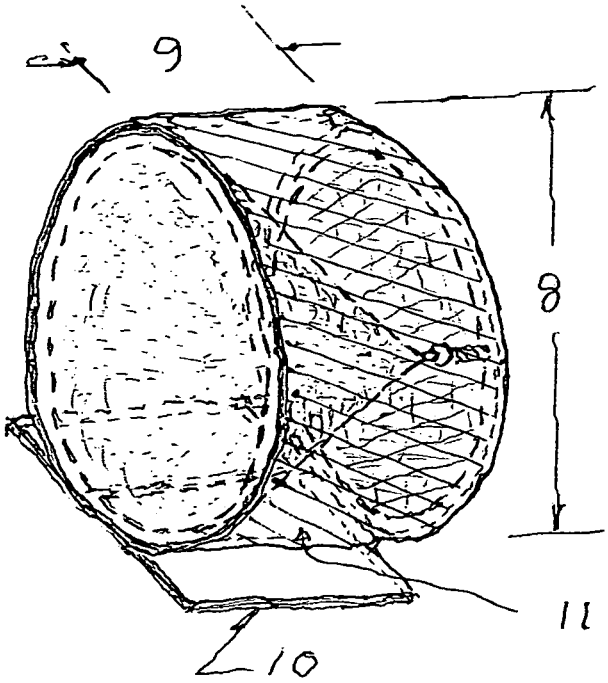

FIG. 4—Cone Element in Cylindrical Enclosure

FIG. 4 is the prospective view of the cone element integrated into a cylindrical enclosure. The outer diameter 8 of the cylindrical enclosure is 6⅜ inches. The enclosure is made from commercially available PVC plastic pipe by cutting the pipe to dimension 9 of 3½ inches in length. The ends are enclosed by two circular PVC plastic pieces which are bonded to the enclosure body. A metal ground plane is bonded to the circular plastic piece where the F connector is connected. The base plate 10 is implemented by bonding a 3½×4 inches plastic piece directly onto the cylindrical body. All dimensions were selected to ensure the antenna performs well over the UHF band and some low frequencies that are associating with the HDTV receptions. Again, injection molding method may also be used to fabricate the cylindrical enclosure. Approximately one half of the inner cylindrical body surface is covered by a thin metal surface 11. This metal surface is bonded to the inner enclosure body. The surface is designed to shape the antenna pattern coverage in reducing multiple reflection effects from the surrounding objects.

DETAIL DESCRIPTION

The subject invention antenna consists of a unique cone shape high efficiency broad band element which is excited by a unique F connector through the antenna ground plane.

Antenna Radiating Element Design

In our discussion of the operating theories, the antenna can be considered as a radiator or as a receiving element. The antenna performs identically in either mode. More often than not the antenna can be explained and understood as a transmitting device.

The radiating element is the most critical part of this invention. Rabbit ears, loops or dipoles radiators are the most commonly use in indoor antenna needs. These antennas are lacking of cost and performance efficiency advantages. What is needed then is a high performance antenna, compact in size, and easily manufactured. The invention antenna disclosed here has all these unique advantages. It is therefore an objective of the present invention to provide such a device.

The radiating element of this disclosure consists of a cone radiator and a ground plane. The cone radiator is positioned perpendicular to a small ground plane. The cone radiator is fabricated by forming the cone through joining the edges of a thin metal dish with a portion of the dish cut out. The cone diameter is 5 inches and the cone angle is 90 degrees.

There are many options that may be employed for fabrication of the cone radiator. Stamping or metal spraying over plastic cones may also be considered.

Antenna Ground Plane

The ground plane enables the cone radiator to perform as a symmetrical structure. It helps eliminate the need of a balun (balanced-to-unbalanced converter). An F connector is connected directly to the cone without the use of a coaxial cable.

This invention provides an effective way and low cost in implementing the indoor antenna.

The antenna efficiency is high because there is no lost between the input connector and the cone radiator.

The antenna radiator is extremely broad band. For high frequencies, the antenna radiator is resonated near apex, and for low frequencies the antenna radiator is resonated at the far end of the cone.

Antenna Enclosure

The FIG. 2 enclosure's outer dimensions are 5¾×5¾×3¼ inch and is formed by bonding several Abs plastic pieces with a 4SC solvent.

Alternatively, the cone element can be enclosed into a plastic cylindrical body such is shown in FIG. 4.

Wood panels may also be used for construction in place of Abs plastics.

Antenna Coverage Pattern

The antenna pattern coverage of the invention antenna is a broad toroid shape. The axis of the pattern is oriented along the cone axis. The antenna polarization is linear and the field lines are parallel to the cone axis.

It should be noted that one of the important feature of the new art antenna is that the antenna radiation coverage is shaped to radiate on one side of the antenna by a unique thin metal surface bonded to the back sidewall of the enclosure. As a result, the unwanted interference signals resulting from the back side of the antenna are minimized.

The invention claimed is:

1. An apparatus comprising: a metal cone, a small metal ground plane of either square or round shapes such that the cone axis is positioned perpendicular to the metal ground plane and forming a mono-conical structure with the cone tip electrically connected to the center pin of a bulkhead connector, the bulkhead connector is attached to the metal ground plane and the ground plane is enclosed by a RF transparent enclosure of either cubical or cylindrical body; a metal surface, surrounding about half way around the cone body, is implemented to minimize any disruptive signals from surrounding objects.

2. The apparatus described in claim 1 whose metal cone element is fabricated by the unique process of folding a copper foil sheet into the cone.

3. The apparatus described in claim 2 has a cone angle is up to 90 degrees and a cone diameter is 5 to 5½ inches.

4. The apparatus described in claim 1, the cubical enclosure outer dimensions are 5¾×5¾×3¼ inches and the cylindrical enclosure has an outside diameter of 6⅜ inches and a height of 3⅜ inches and the apparatus sits on a base plate of 3⅜ by 4.0 inches.

5. The apparatus in claim 1, the ground plane is bonded to an enclosure side wall and the metal surface surrounding the cone body half way is electrically decoupled from the cone body and the small metal ground plane.

6. The apparatus in claim 1, the cubical enclosure is fabricated by bonding Abs plastic pieces while the cylindrical plastic enclosure is formed by closing the pipe ends by round plastic pieces.

7. The apparatus in claim 1 is able to reduce its size by nearly 50% because the image effect of the ground plane; the apparatus operates much like a two cones bi-conical horn radiator with only one cone and a small ground plane.

8. The apparatus of claim 1 utilizes the wide cone angle of 90 degree to help obtain wide band impedance match over the operating frequency band.

9. The apparatus in claim 1 having a bulkhead connector of F female type and is bolted to the ground plane through enclosure body; a RG 6 type of coaxial cable of suitable length may be used to connect the apparatus to a TV set.

* * * * *